US007955018B2

(12) United States Patent
Abergel

(10) Patent No.: US 7,955,018 B2
(45) Date of Patent: Jun. 7, 2011

(54) APPLICATOR AND A PACKAGING AND APPLICATOR DEVICE

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 1105 days.

(21) Appl. No.: 11/727,872

(22) Filed: Mar. 28, 2007

(65) Prior Publication Data

US 2007/0227552 A1 Oct. 4, 2007

Related U.S. Application Data

(60) Provisional application No. 60/802,124, filed on May 22, 2006.

(30) Foreign Application Priority Data

Mar. 31, 2006 (FR) ..... 06 51148

(51) Int. Cl.
*B05C 17/00* (2006.01)

(52) U.S. Cl. ..... 401/208; 401/123; 401/126; 132/317

(58) Field of Classification Search ..... 401/208, 401/218–220, 6, 123, 126; 15/230.11; 132/317
See application file for complete search history.

(56) References Cited

U.S. PATENT DOCUMENTS

| | | | | |
|---|---|---|---|---|
| 4,483,636 | A * | 11/1984 | Meyer | 401/266 |
| 4,961,661 | A | 10/1990 | Sutton et al. | |
| 5,176,754 | A * | 1/1993 | Hirzel | 118/258 |
| 5,735,623 | A | 4/1998 | Gueret | |
| 5,845,659 | A | 12/1998 | Hutchins | |
| 6,244,776 | B1 * | 6/2001 | Wiley | 401/208 |
| 6,682,246 | B2 * | 1/2004 | Reggiani | 401/264 |
| 6,953,298 | B2 * | 10/2005 | Healy | 401/193 |
| 7,101,106 | B1 * | 9/2006 | Wiley | 401/210 |
| 7,153,053 | B1 * | 12/2006 | Wiley | 401/219 |
| 7,281,291 | B1 * | 10/2007 | Hajianpour | 15/230.11 |
| 2004/0033102 | A1 | 2/2004 | De Laforcade | |
| 2004/0129284 | A1 | 7/2004 | Abergel | |
| 2005/0020948 | A1 | 1/2005 | Gueret | |

FOREIGN PATENT DOCUMENTS

| | | | |
|---|---|---|---|
| DE | 40 30 334 | C1 | 4/1992 |
| DE | 42 36 050 | A1 | 11/1993 |
| EP | 1 362 524 | A1 | 11/2003 |
| EP | 1 362 525 | A1 | 11/2003 |
| EP | 1 393 649 | A1 | 3/2004 |
| EP | 1 498 045 | A1 | 1/2005 |
| FR | 2 838 936 | A1 | 10/2003 |
| FR | 2 848 790 | A1 | 6/2004 |
| GB | 2 160 105 | A | 12/1985 |
| RU | 27998 | U1 | 3/2003 |
| WO | WO 92/04842 | | 4/1992 |
| WO | WO 01/62519 | A1 | 8/2001 |
| WO | WO 2005/104898 | A1 | 11/2005 |

* cited by examiner

*Primary Examiner* — David J Walczak
(74) *Attorney, Agent, or Firm* — Oliff & Berridge, PLC

(57) ABSTRACT

A packaging and applicator device for a makeup composition includes a receptacle for containing the composition and an applicator for applying the composition. The applicator includes a handle of elongate shape, having a longitudinal axis and a rotary applicator member movable relative to the handle about an axis of rotation that does not coincide with the longitudinal axis, the applicator member defining an applicator surface that projects outwards between free surfaces of the applicator member and that is for loading with composition. The axis of rotation is inclined relative to the longitudinal axis and is not perpendicular thereto; and/or the applicator member is offset laterally relative to the handle so that a proximal side of the applicator surface is free.

41 Claims, 5 Drawing Sheets

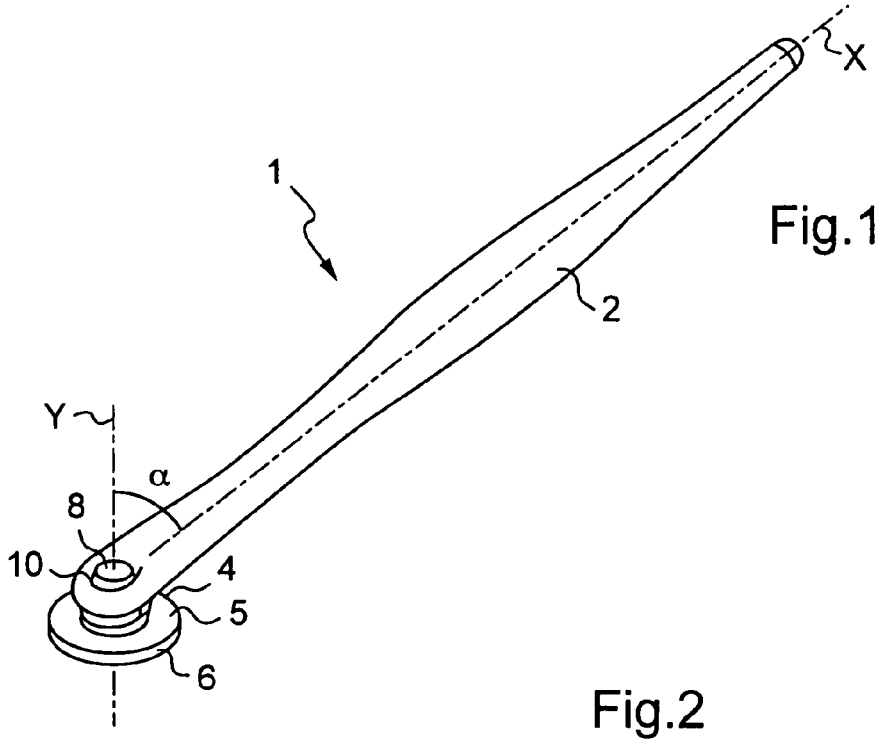
Fig.1
Fig.2
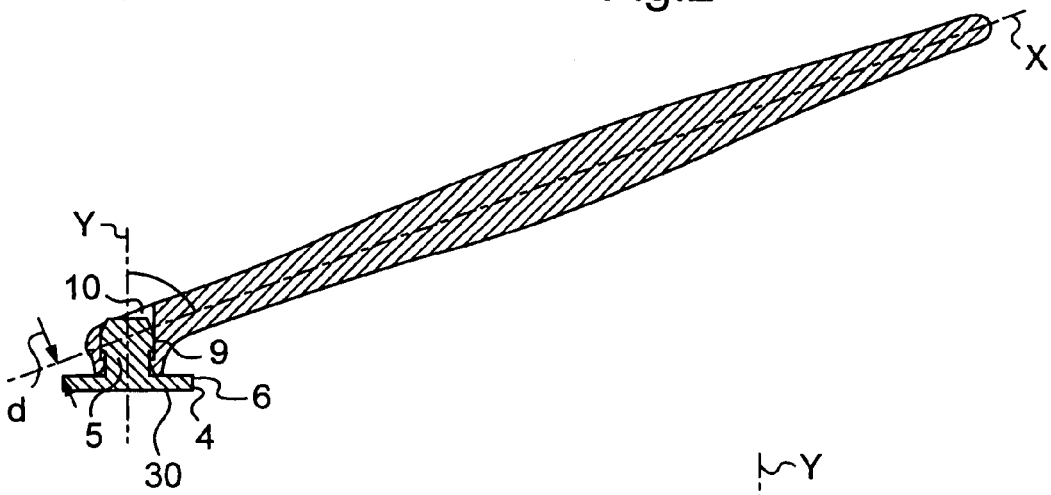
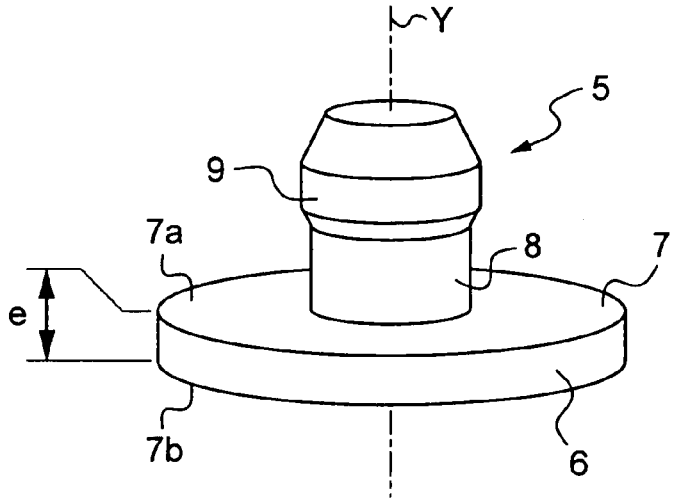
Fig.3

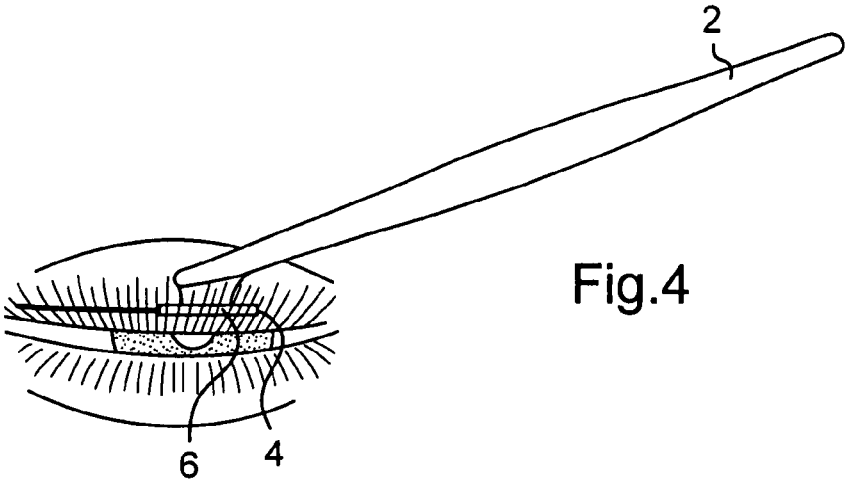
Fig.4
Fig.5
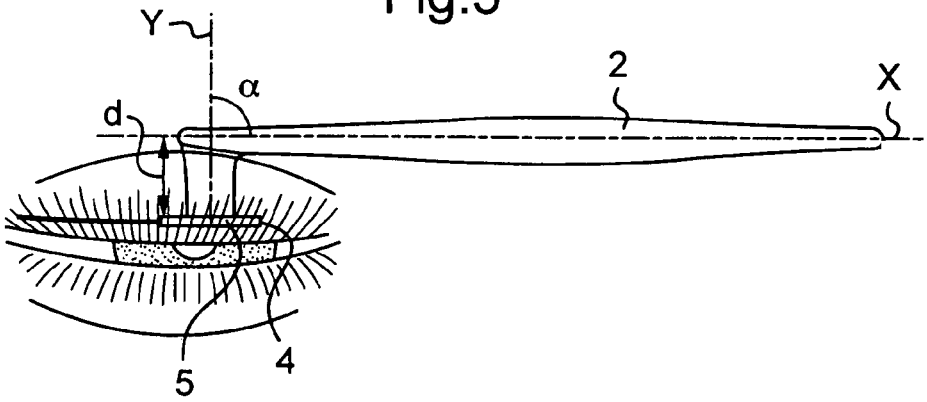
Fig.6
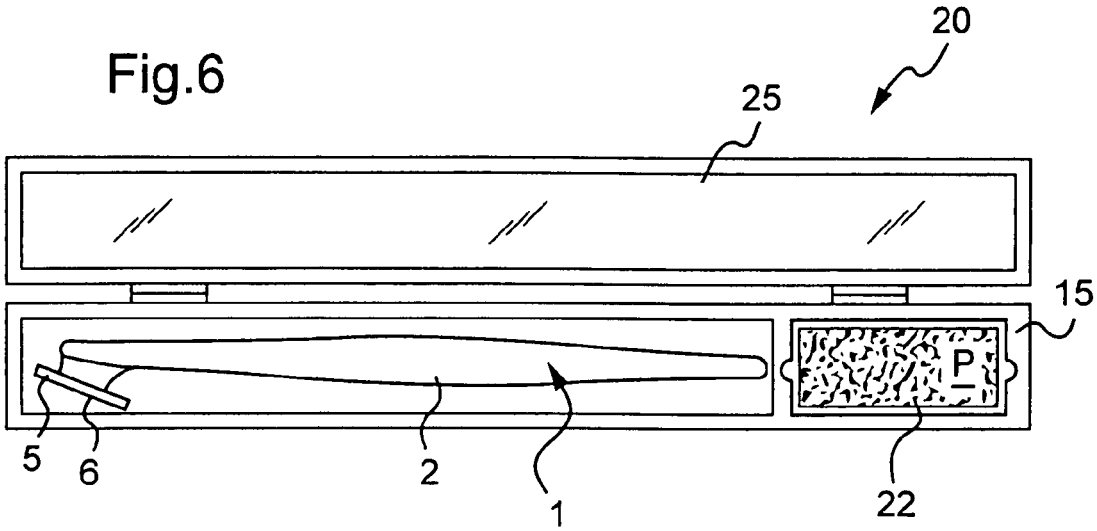

APPLICATOR AND A PACKAGING AND APPLICATOR DEVICE

This non provisional application claims the benefit of French Application No. 06 51148 filed on Mar. 31, 2006 and U.S. Provisional Application No. 60/802,124 filed on May 22, 2006.

The present invention relates to applicators configured to apply a composition comprising a cosmetic, makeup, and/or care product on keratinous materials, and in particular on the skin or the lips.

The invention relates more particularly, but not exclusively, to applicators for making up the top and/or bottom eyelids, in particular for drawing a line thereon.

By way of example, the composition may be an eyeliner. For example the composition may be other than an eye shadow.

The invention also relates to packaging and applicator devices including such applicators.

The term "cosmetic" is used to mean a cosmetic product as defined in the Jun. 14, 1993 Council Directive 93/35/EEC amending Directive 76/768/EEC. By way of example, it is constituted by a makeup composition containing pigments, such as an eyeliner.

Applicators fitted with a rotary applicator member are known from patent application EP-A1-1 393 649 and EP-A1-1 498 045, which disclose applicator members that rotate about an axis of rotation perpendicular to the longitudinal axis of the handle.

Under certain conditions, applying the composition is made relatively difficult because the hand of the user tends to hide the applicator member which can be harmful to achieving precise application.

Patent application EP-A1-1 498 045 mentions that the axis of rotation of the applicator member could in a variant be parallel to the longitudinal axis of the handle. However such a configuration is not very comfortable and can likewise make application imprecise.

There thus exists a need to further improve existing applicators, for example in order to make it easier to apply the composition and improve the precision with which it is applied.

There also exists a need to create novel makeup effects.

The invention provides an applicator for applying a cosmetic composition, for example on the eyelids, the applicator comprising:

a handle of elongate shape having a longitudinal axis; and a rotary applicator member movable relative to the handle about an axis of rotation that does not coincide with the longitudinal axis, the applicator member defining an applicator surface for being loaded in composition for application on a region that is to be made up.

According to exemplary embodiments of the invention, the axis of rotation may be inclined relative to the longitudinal axis and not perpendicular thereto;

and/or the applicator member may be offset laterally relative to the handle, so that the proximal side of the applicator surface is free.

The term "handle" should not be understood restrictively, and it covers any grip system made as a single part or as an assembly of a plurality of parts.

In use, the applicator member can be moved by the user over the eyelid, for example, without the handle or the hand of the user excessively impeding sight of the region to be made up or of the applicator member, thus facilitating application and improving precision.

The angle of inclination of the axis of rotation and/or the offset of the applicator surface relative to the handle is/are preferably sufficient to avoid masking the zone to be made up that is adjacent to the applicator member, i.e. where the composition is to be deposited as the applicator member rolls along.

The axis of rotation of the applicator member may be inclined relative to the longitudinal axis of the handle at an angle that is non-zero and that is strictly less than 90°. By way of example, this angle may lie in the range 10° to 80°, better in the range 20° to 70°, in particular in the range 30° to 60°.

The axis of rotation of the applicator member and the longitudinal axis of the handle may optionally intersect, being optionally coplanar.

When the applicator surface is offset laterally relative to the longitudinal axis of the handle, the proximal side of the applicator surface may be free.

The term "proximal side of the applicator surface" should be understood as being the side thereof that is directed towards the proximal end of the handle.

By way of example, the applicator surface of the applicator member is offset from the longitudinal axis of the handle by a gap of width greater than 1 millimeter (mm), or even 2 mm, 3 mm, 4 mm, 5 mm, or 6 mm, where a relatively large width can improve visibility both of the zone to be made up and of the applicator member. The width of the above gap is defined as being the shortest distance measured perpendicularly to the longitudinal axis of the handle between the handle and the applicator surface.

The perimeter of the applicator member may correspond substantially to the length of a set of eyelashes, or may be even longer, so as to make it possible once the applicator surface has been loaded with composition, to apply makeup to an eyelid without it being necessary to refill the applicator surface while making up that eyelid, for example.

The perimeter of the applicator surface may be greater than or equal to 30 mm, for example.

The applicator may be configured to enable a continuous or interrupted line to be drawn, e.g. on the eyelids or on the lips, or indeed a plurality of lines, e.g. along the set of eyelashes, or indeed around the outline of the lips.

The width of the pattern formed may be less than 3 mm, or even less than 2 mm, or indeed less than 1 mm.

The applicator surface may project outwards between free surfaces of the applicator member, in particular in a section plane that includes the axis of rotation of the applicator member.

The applicator member may be bordered on either side by one or more free surfaces of the applicator member, e.g. two free surfaces which do not contact the handle.

The free surface(s) need not serve for applying composition. They may extend radially relative to the axis of rotation. They may be visible to the observer, in particular when the applicator member is observed from the side. They may be free over a width of at least 1 mm, or indeed at least 2 mm, or even at least 3 mm. The connection between the free surface(s) and the applicator surface may be a right angle or substantially a right angle.

The applicator surface may have no concave surface. The applicator surface may be plane or convex, e.g. tapering towards the point(s) of contact with the application surface. In a variant, the applicator surface may be slightly concave, or indeed inclined relative to the axis of rotation.

The greatest diameter of the applicator surface may be greater than a greatest width of the applicator surface.

In exemplary embodiments of the invention, the applicator surface may be entirely free.

The applicator member may be connected to the handle by a pivot disposed entirely on one side only of the applicator surface. By way of example, the pivot may comprise a hub turning in a corresponding housing. The housing may be formed in one end of the handle and the hub may be secured to the applicator member, e.g. being made integrally therewith by molding, or vice versa. The housing receiving the hub may be a through housing. The hub may be snapped into the housing or may be retained therein in some other way, e.g. by fitting a retaining clip.

The hub may come into contact with a portion only of the free surface. The free surface may have a free annular zone, e.g. surrounding the hub.

The applicator surface may be defined by a removable part, thus enabling the user to modify the pattern or the line that is drawn, for example, or enabling the user to avoid contaminating one composition with another. The applicator surface may also be defined by a one-piece applicator member that is mounted on the handle in optionally removable manner. In a variant, the applicator member may comprise a plurality of parts and the applicator surface may be removable relative to a portion that is not removable from the handle, being permanently secured thereto. By way of example, the applicator surface may be defined by an O-ring received in an annular groove of the portion that is not removable from the applicator member.

The longitudinal axis of the handle may be rectilinear or curvilinear.

The applicator member may be made entirely out of a material that is relatively rigid, for example a polyolefin, or polyacetyl (POM).

In a variant, the applicator member may be made at least in part out of an elastomer, e.g. styrene butadiene rubber (SBR), ethylene propylene diene monomer (EPDM), nitrile rubber, thermoplastic elastomers, and in particular styrene-ethylene-butadiene-styrene (SEBS).

The applicator member may be made in a non porous material such as for example a polyolefine, for example low density PE, high density PE, PP, a thermoplastic elastomere, for example SANTOPRENE® (SBS-SEBS) or ENGAGE® (octene ethylene from the company SAFIC ALCAN DOW) or HYTREL® (polyester elastomere from the company DUPONT) or TVU, with possibly a flocking on the applicator surface.

The applicator member may also be made with a sintered material or a foam with open or closed cells.

The applicator surface may be grained or with holes or recesses.

The applicator member may optionally be made at least in part out of a porous material, e.g. a thermoplastic foam, an elastomer foam, or possibly a thermoplastic elastomer foam.

The applicator member may be elastically deformable.

The applicator member may be made out of a single material, or out of a plurality of materials, e.g. by dual injection, with the applicator surface for example being made of a material that is more flexible so as to increase its coefficient of friction against the skin.

When a portion of the applicator member acts as a pivot, said portion is advantageously made of a material that is relatively rigid so as to reduce friction between the applicator member and the handle.

The angle of inclination of the axis of rotation relative to the handle can be non-adjustable and determined on manufacture. In a variant, the angle of inclination of the applicator member relative to the grip member is adjustable, e.g. by means of a sleeve having a distal portion that can be swiveled with the applicator member being pivoted thereto. By way of example, the swivel-mounted distal portion may be connected to the remainder of the handle via a notched connection so as to enable the user to modify the angle of inclination in discrete amounts, or via a connection without notches so as to enable the angle of inclination to be modified continuously.

The applicator surface may be formed by an annular surface of width that is optionally constant, depending on the line it is to draw. The applicator surface may be continuous so as to draw a line that is continuous while it is rolling.

In a variant, the applicator surface may be discontinuous, e.g. comprising studs or other portions in relief, so as to draw a line that is discontinuous. The studs or other portions in relief may optionally be uniformly distributed angularly around the periphery of the applicator member, depending on whether the patterns that are drawn are to be equidistant or otherwise.

The applicator surface of the applicator member may have two or more disjoint regions. The disjoint regions may share a common axis and they may be offset laterally along the axis of rotation so as to draw parallel lines or patterns, depending on the desired effect.

The applicator surface may be circularly cylindrical, toroidal, or tapering.

The applicator surface may optionally be flocked.

The applicator member may include at least one reference mark, in particular on its front face, to inform the user of the actual rotation of the applicator member relative to the handle, e.g. while application is taking place, so as to cause the user to clean the applicator if the applicator member ceases to turn properly relative to the handle.

The reference mark may also improve appearance or serve to index a region of the applicator surface relative to a zone of the eyelid so as to draw a line in a manner that is positioned relative to the eyelid, e.g. a series of patterns of spacing and/or size that varies in increasing or decreasing manner going from one end to the other along the eyelid.

The applicator may include a closure member configured to receive the applicator member when not in use.

In an exemplary embodiment, the handle may define a receptacle containing the composition for application. Where appropriate, the applicator surface may then be configured to come into contact with the composition contained in the handle in order to load composition thereon.

The invention also provides a packaging and applicator device for a composition, the device comprising:

a receptacle for containing at least one composition for application; and an applicator as defined above.

The receptacle and the applicator may be separate.

In a variant, the receptacle may constitute a handle of the applicator, for example.

Such a device may include a mirror and associated lighting, where appropriate.

At least one composition may be stored in the device in the form of a cake of composition, e.g. a compacted powder or a casting. In a variant, the composition may be stored within a porous substrate suitable for absorbing it and delivering it to the applicator surface. The porous substrate may comprise a cellular or fibrous material, in particular a foam, a sintered material, a felt, or a woven or non-woven fabric.

The composition may also be brought directly to the applicator surface via a feed channel, e.g. when the composition is contained in the handle.

The device may include at least two different compositions, e.g. of different colors.

The receptacle may define a free interior space in which the applicator member may be inserted. This internal space is for example cylindrical of revolution on at least a portion of its height, for example with an inside diameter ranging from 7 to 20 mm, for example about 8 mm.

The transverse greater dimension of the applicator member, measured perpendicularly to the longitudinal axis of the receptacle, ranges for example from 4 to 10 mm, being for example about 5 mm.

The applicator member may comprise two faces defining, in an axial section, an angle ranging from 20° to 90°. These faces may define at their junction the applicator surface.

A face of the applicator member, situated on the side of the handle may make with a rotation axis of the applicator member an angle ranging from 120° to 160°, for example.

The applicator member may be carried by a stem which may have a rectilinear portion that is off centered relative to the longitudinal axis of the receptacle. This may facilitate the applicator surface coming into contact with the product or with a foam situated inside the receptacle, so as to load the applicator surface with product and/or to wipe the applicator surface.

The rectilinear portion of the stem may connect to an insert which may have a shape symmetrical of revolution in an off centered manner, the insert serving to fix the stem to a closure cap.

The invention also provides a method of making up the skin or the lips, in particular the top or bottom eyelid, the method comprising the following steps:

- providing an applicator as defined above, or a packaging and applicator device as defined above;
- applying the applicator member to the skin; and
- moving the applicator in such a manner as to cause the applicator member to turn in rotation in contact with the skin.

Where appropriate, when the applicator surface is not circularly symmetrical, the method may include a step consisting in positioning the applicator member in a particular position relative to the region that is to be made up before causing it to turn.

By way of example, the applicator surface may be defined by a series of studs at a spacing that increases circumferentially around the periphery of the applicator member. By causing the applicator member to turn from an identified position in contact with the eyelid, the user can draw dots at a spacing that increases going towards the outside of the eye or towards the inside.

Similarly, when the applicator surface presents a width that increases in the circumferential direction, the user can draw a line that becomes wider going towards the inside of the eye or towards the outside of the eye.

In another of its aspects, independently or in combination with the above, the invention also provides a packaging and applicator device comprising:

- a receptacle;
- a sleeve of a porous substrate impregnated with a composition for application, and contained inside the receptacle; and
- an applicator including a rotary applicator member at one end and arranged to be inserted into the receptacle in order to enable an applicator surface to be loaded with the composition.

In particular, the applicator may be as defined above, with the applicator member turning about an axis of rotation that extends obliquely relative to the longitudinal axis of the handle, and/or being offset relative thereto.

The porous substrate may be an elastically-compressible foam having open cells and impregnated with the composition.

The inside diameter of the sleeve may be sufficiently small to enable the applicator member to come into contact with the radially-inside surface of the sleeve during storage and/or while the applicator is being extracted.

Its handle may be arranged to close the receptacle in leak-tight manner. The handle may, in particular, include a threaded skirt arranged to be screwed onto a neck of the receptacle.

The invention also provides, according to a further object, a conditioning and packaging device comprising:

- a receptacle containing a substance to apply on keratinous materials,
- an applicator comprising:
  - a stem connected at a first end to a closure cap for closing the receptacle,
  - an applicator member rotative relative to the stem, the applicator member being connected to a second end of the stem opposite the first end, the stem having an upper portion which is off centered relative to the longitudinal axis of the receptacle, the applicator member coming into contact, via an applicator surface, with an inside surface of the receptacle loaded with product, for example an interior surface defined by a cylinder of product or by a porous material, possibly loaded with product.

The invention can be better understood on reading the following detailed description of non-limiting embodiments of the invention and on examining the accompanying drawings, in which:

FIG. 1 is a diagrammatic perspective view of an applicator in accordance with the invention;

FIG. 2 is a diagrammatic longitudinal section of the FIG. 1 applicator;

FIG. 3 is a perspective view showing in isolation the applicator member of FIGS. 1 and 2;

FIG. 4 shows the applicator of FIGS. 1 to 3 in use;

FIG. 5 shows a variant embodiment of the applicator and shows it in use;

FIGS. 6 and 7 are diagrammatic and fragmentary views of devices including an applicator in accordance with the invention;

Figure 20:
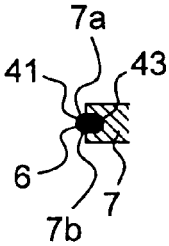
Figure 21:
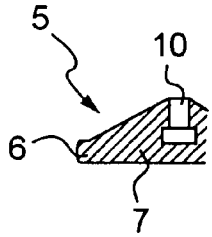
Figure 22:
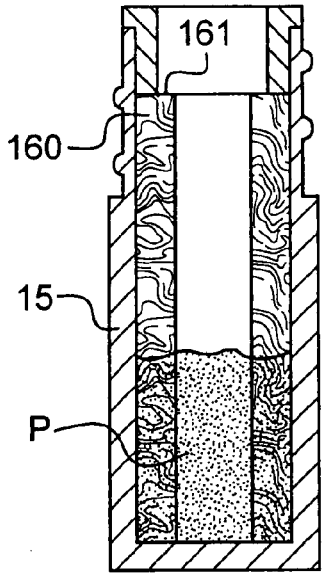
Figure 23:
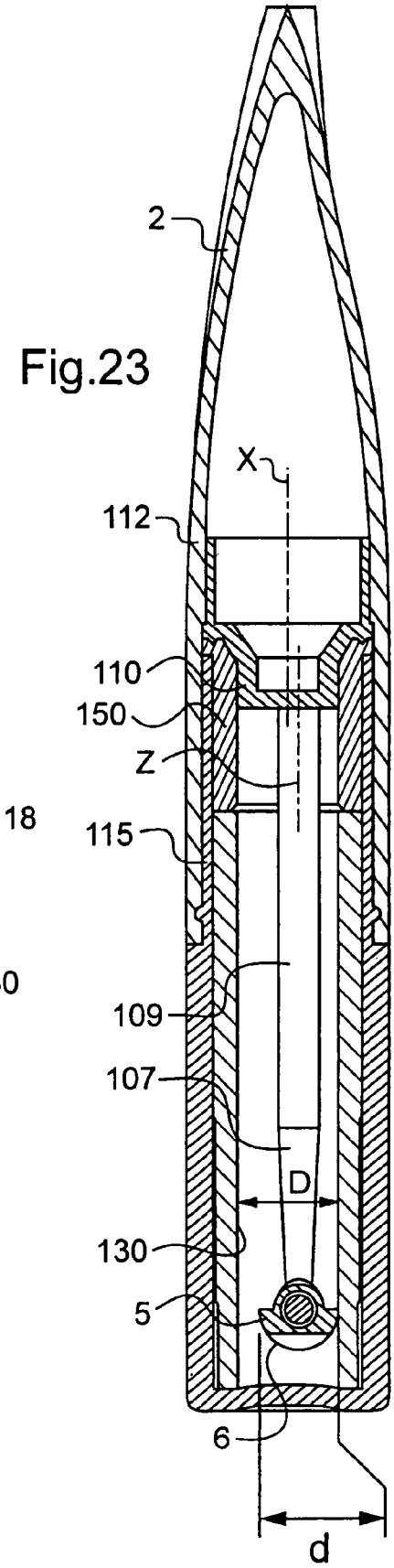
Figure 24:
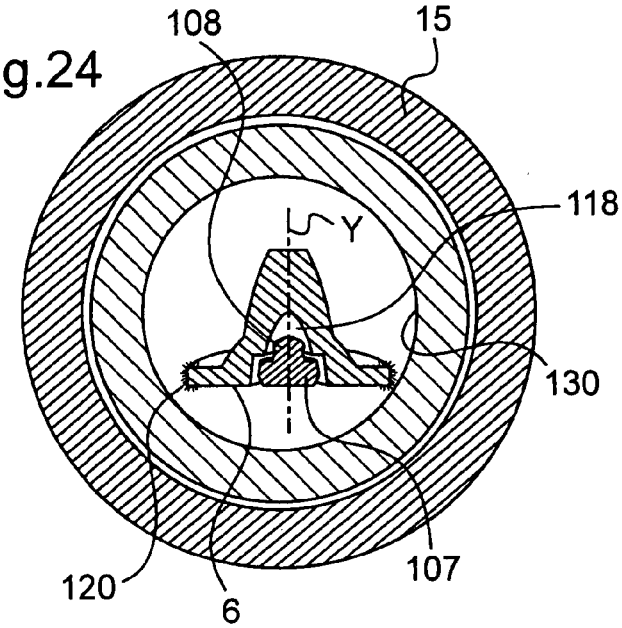

FIGS. 10 to 13, 15, and 17 show examples of traces drawn by the applicator surface of the applicator on the region to be made up;

FIGS. 14, 16, and 18 to 21, and 25 are fragmentary diagrammatic views of variant embodiments of applicator members in accordance with the invention, FIG. 22 shows in isolation, in a longitudinal section, a variant of the receptacle, FIG. 23 shows in a longitudinal section a device made in accordance with a variant embodiment, and FIG. 24 is diagrammatic and fragmentary cross-section of the device of FIG. 23.

FIGS. 1 to 4 show an applicator 1 in accordance with the invention, comprising a handle 2 that extends along a longitudinal axis X that is rectilinear in the example shown.

The applicator 1 further comprises an applicator member 5 shown in isolation in FIG. 3, which member defines an applicator surface 6 at its periphery. The applicator surface has for example a width e ranging from about 0.2 to 5 mm, being for example about 0.6 mm.

The applicator member 5 comprises a disk 7 having a hub 8 connected thereto, which hub includes a projection 9 enabling it to be snap-fastened in a corresponding housing 10 formed at one end of the handle 2.

In a variant, the applicator member 5 may include a housing 10, as shown in FIG. 21, and the handle member may include a hub engaged therein.

The hub 8 and the housing 10 constitute a pivot, enabling the applicator member 5 to rotate relative to the handle 2 about an axis of rotation Y.

The applicator member 5 could be pivoted to the handle 2 in some other way, for example by means of a ball bearing or a pin fitted through axially-aligned housings in the disk and the handle 2.

The hub 8 does not project far beyond the handle 2 in the example shown in FIGS. 1 and 2, but in a variant that is not shown, the applicator member 5 could be secured to a wheel situated on the side of the handle opposite from the applicator surface 6, thus making it possible, for example, for the user to see more clearly the rotation of the applicator member 5, or to facilitate positioning it in a predefined orientation, or indeed to enable the user to prevent it from rotating for cleaning purposes or to achieve a particular makeup effect.

In the example shown in FIGS. 1 to 4, the axis of rotation Y forms an angle $\alpha$ relative to the longitudinal axis X that is equal to about 70°. Naturally, it would not go beyond the ambit of the present invention for the angle $\alpha$ to be different, e.g. lying in the range 10° to 80°. The angle $\alpha$ is preferably not zero. Also preferably, the angle $\alpha$ is strictly less than 90°.

In the example described, the applicator surface 6 is of circularly cylindrical annular shape and continuous, being defined by a plane edge surface at the periphery of the disk 7.

Once the applicator surface has been loaded with composition, the user can move the applicator 1 so as to cause the applicator surface 6 to roll along the region to be made up. The composition that is transferred may form a regular line, as can be seen in FIG. 4.

The lateral surfaces 7*a* and 7*b* adjacent to the surface 6 are free and spaced along the axis Y from the handle 2 by a distance which is for example greater than 2 mm.

In the example shown, the applicator surface 6 extends perpendicularly to the free surfaces 7*a* and 7*b*.

The free surfaces 7*a* and 7*b* may extend radially relative to axis Y on a distance greater than 1 mm, for example.

In the example of FIGS. 1 and 2, the angle $\alpha$ is not equal to 90°. It would not go beyond the ambit of the present invention for the angle $\alpha$ to be substantially equal to 90°, as shown in FIG. 5.

In this example, the applicator surface 6 of the applicator member 5 is offset laterally relative to the handle 2 by an amount that may be of width d greater than 2 mm, or indeed greater than 4 mm or better 6 mm. The distance d is measured perpendicularly to the longitudinal axis X between the edge of the applicator surface 6 and the longitudinal axis X.

In the example shown, the applicator surface 6 of the applicator member 5 is offset from the handle 2 sufficiently for its proximal side 4 to be free. This facilitates application, since the user can predict better the path that the applicator member will follow in the region to be made up and can see more clearly the trace that has already been made.

Figure 7:
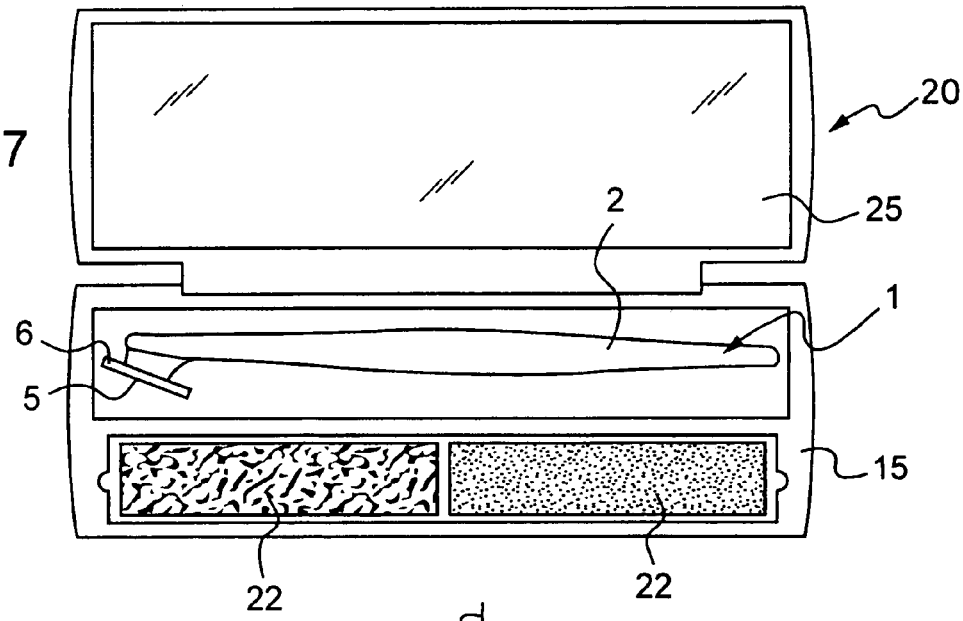

The applicator may be associated with a receptacle 15 containing at least one composition P for application, so as to constitute a packaging and applicator device 20, of the kinds shown for example in FIGS. 6 and 7.

In FIG. 6, the device 1 comprises a case housing a supply 22 of composition P against which the user can bring the applicator surface 6 in order to load it with composition before applying it to the skin.

The supply 22 of composition may be in the form of a cake of a composition that is in compacted powder form, for example, or it may be a porous substrate impregnated with a composition P that is in fluid form.

The case 20 may also include a mirror 25 and, where appropriate, an integrated lighting system.

The device of FIG. 7 differs from that of FIG. 6 in that it includes a plurality of different compositions.

The case may include a housing for the applicator, and where appropriate, one or more housings for different applicator members or for component parts of the applicator member enabling different traces to be made.

Figure 8:
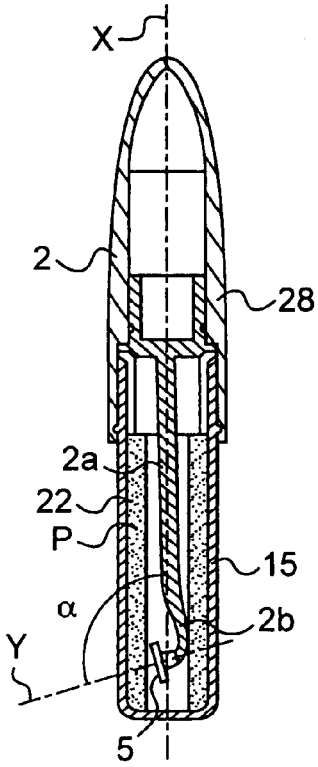
FIGS. 8 and 9 are diagrammatic and fragmentary longitudinal sections of devices including an applicator in accordance with the invention.

In the variant of FIG. 8, the composition P is contained in a hollow receptacle 15 into which the applicator needs to be inserted, at least in part, in order to be loaded with composition.

In this example, it may be observed that the handle 2 comprises a stem 2*a* whose distal end 2*b* is offset away from the applicator member 5. This makes it easier to insert it in the receptacle and load it with composition. In this example, the end of the handle is snapped into a housing of the applicator member. The longitudinal axis X taken into consideration for defining the angle $\alpha$ is the angle between the portion held by the user while applying the composition.

By way of example, the composition P may be absorbed in a sleeve 22 of a porous substrate covering the inside wall of the receptacle 15.

When not in use, the handle 2 closes the receptacle 15, preferably in leaktight manner when the composition P contains a volatile solvent.

By way of example, the applicator member 5 can be loaded by the applicator surface 6 coming into contact with the radially-inner surface of the sleeve 22 while the applicator is being withdrawn.

The sleeve 22 may be made of an elastically-compressible foam having open cells, and it may have an inside diameter that is small enough to ensure contact with the applicator surface 6, and in particular with sufficient pressure to cause the applicator member to be rotated on being extracted.

Figure 9:
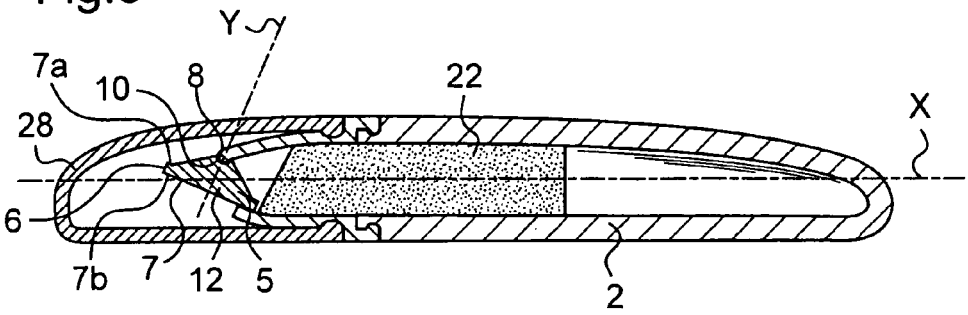

In a variant embodiment, the handle 2 houses the supply 22 of the composition P, as shown in FIG. 9.

By way of example, the composition P impregnates a porous substrate contained inside the handle 2 so that the applicator surface 6 can come into contact therewith and become loaded with composition as it rotates.

The applicator of FIG. 9 may be fitted with a closure cap 28 enabling the applicator member 5 to be covered when not in use.

In a variant that is not shown, the applicator 1 is secured to a packaging and applicator device for a different composition, for example being mounted on a receptacle containing said different composition or on a closure member of said receptacle. By way of example, the different composition is complementary to that for application using the rotary applicator of the invention, e.g. a mascara, an eyeshadow, or a lipstick.

In a variant that is not shown, the handle 2 includes a second applicator member at its end opposite from the applicator member 5, thus making it possible to apply the same composition, for example, but over a surface that is wider or for finishing purposes, or else to apply a different composition.

Where appropriate, the front face 30 of the applicator member may also be used for application purposes, e.g. for applying the composition over a larger area.

By way of example, the applicator surface 6 may be used for drawing an outline, while the front face 30 serves to apply the composition on one side of the outline.

By way of example, the front face 30 may be plane, as shown in FIGS. 1 to 3, or in a variant it may be concave or convex, and it may optionally be flocked.

There follows a more detailed description of other variant embodiments of the applicator member 5.

In the examples described above, the disk 7 of the applicator member 5 is of constant thickness over its entire periphery so as to define an applicator surface 6 that is continuous and of constant width.

Different applicator surfaces 6 can be provided so as to draw a variety of patterns or lines on the skin.

Figure 10:
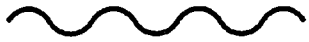

For example, it is possible to use an applicator member 5 having an applicator surface that undulates, so as to draw a wavy line, as shown in FIG. 10.

Figure 11:
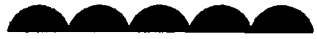

The applicator surface 6 may include portions in relief, e.g. serving to produce a line of thickness that varies periodically, as shown in FIG. 11.

Figure 12:
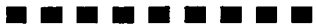
Figure 13:
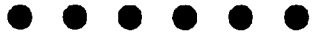
Figure 14:
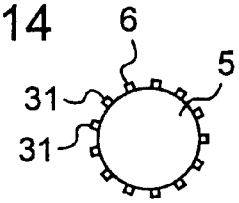

The applicator surface 6 may be defined by studs 31 or other portions in relief, as shown in FIG. 14, so as to draw lines of dots of rectangular or circular shape, as shown in FIGS. 12 and 13.

These studs 13 or other portions in relief may be distributed equally around the circumference of the applicator member 5, as shown in FIG. 14.

Figure 15:
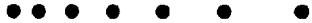
Figure 16:
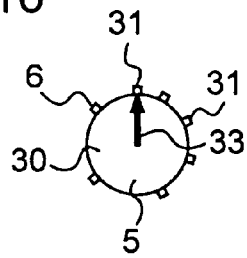

In a variant, the studs 31 or other portions in relief may be distributed in non-uniform manner around the circumference of the applicator member 5, as shown in FIG. 16, so as to draw patterns on the skin at a spacing that is not constant, e.g. that increases, as shown in FIG. 15.

The perimeter of the applicator member 5 may correspond substantially to the length of a set of eyelashes, for example, and the applicator member 5 may include at least one reference mark 33 enabling the user to apply the applicator member 5 to the eyelid in well-defined manner at one end thereof. Thereafter, by turning the applicator surface 6 in contact with the skin, the user can draw on the eyelid patterns at spacing that increases progressively from one end to the other of the eyelid.

Figure 17:
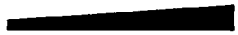
Figure 18:
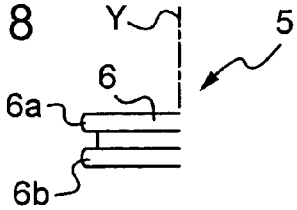

The applicator surface 6 may present a width that is constant over its entire circumference, or a width that varies, e.g. for the purpose of drawing a line of increasing width as shown in FIG. 17.

The applicator member 5 may also be made in such a manner as to draw at least two lines simultaneously on the skin.

By way of example, the applicator surface 6 may comprise two portions 6*a* and 6*b* that are axially offset along the axis of rotation Y, so as to draw two parallel lines.

The presence of disjoint portions on the applicator surface 6 may also be useful for filling each of these portions with different compositions and drawing simultaneously two lines of different colors, or a line of one color or another by selecting which portion 6*a* or 6*b* of the applicator surface 6 is applied against the skin, by appropriately tilting the applicator member 5. The portions 6*a* and 6*b* may present shapes that are identical or different, depending on the makeup that is to be achieved.

Figure 19:
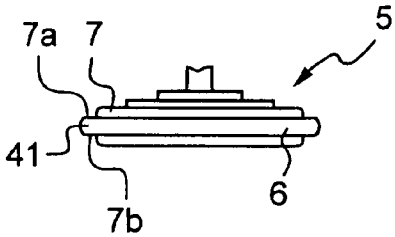

The applicator surface 6 may also be defined by a part of annular shape 41, such as an O-ring, that is releasably fastened on a non-removable portion of the applicator member, as shown in FIGS. 19 and 20.

A groove 43 may be formed in the periphery of the disk 7 for receiving the part 41.

By way of example, this enables the user to select amongst parts defining different applicator surfaces 6 the part having the patterns to be made on the skin.

This can also make it possible to clean the applicator surface or to replace it when a different composition is to be used.

The use of a separate part fitted on in order to define the applicator surface can also optionally enable the user to have an applicator surface made of a material with a coefficient of friction against the skin that is greater, thus making it easier to transfer the composition and to cause the applicator member to rotate.

This can also make it possible for the hub or the pivot housing to be made of a material that is relatively rigid, and that presents a low coefficient of friction.

Figure 25:
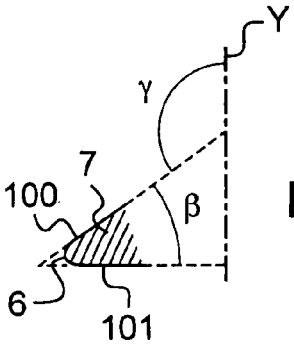

The applicator surface may also, as shown in FIG. 25, be defined at the junction of two faces 100 and 101 of the applicator member which make an angle β between them which is for example ranging between 20 and 90°.

The angle γ between the face 100 of the applicator member which is situated on the side of the handle and the rotation axis Y is for example ranging between 120 and 160°.

In the embodiment of FIGS. 23 and 24, the applicator member 5 is mounted at the end of a stem 107.

The stem 107 has an upper rectilinear portion 109 having a longitudinal axis Z which is off a centered relative to the longitudinal axis X of the receptacle.

The upper portion 109 connects to an insert 110 fixed in a cap 112, the cap 112 being configured for screwing on a threaded neck 115 of the receptacle.

The applicator member 5 is for example fixed to the stem 107 by snap-fastening, the stem 107 comprising for example as shown in FIG. 24 a head 108 snap-fastened into a housing 118 of the applicator member 5.

One sees on FIG. 24 that the applicator surface 6 may comprise a flocking 120.

The applicator member may contact by a side of the applicator surface 6 an internal surface 130 of the receptacle for loading of product, as shown in FIG. 24.

The internal surface 130 is for example defined by a hollow cylinder of product or by a porous support impregnated with product. This cylinder or support may be hold in the receptacle, if appropriate, with a ring 150 fixed to the neck as shown in FIG. 23.

The internal surface 130 may be cylindrical of revolution of inside diameter D ranging from 7 to 20 mm for example, preferably close to 8 mm.

The transverse greater dimension d of the applicator member may range from 4 to 10 mm for example, being preferably close to 5 mm.

In the variant embodiment shown on FIG. 22, the receptacle comprises a sleeve 160. The part of the sleeve 16 which is situated above the level of product may serve to remove an excess of product on the applicator surface, the applicator surface coming into contact with the sleeve 160. The product P may be liquid in this example. The sleeve 160 may comprise a porous material such as a foam.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The term "comprising a" should be understood as being synonymous with "comprising at least one" unless otherwise specified.

What is claimed is:

1. A packaging and applicator device for a makeup composition to apply on skin or lips, the device comprising:

a receptacle containing the skin or lips composition; and an applicator, separate from the receptacle during applying the composition, the applicator comprising:

a handle of elongate shape, having a longitudinal axis; and a rotary applicator member movable relative to the handle about an axis of rotation that does not coincide with the longitudinal axis, the applicator member defining an applicator surface that projects outwards between free surfaces of the applicator member and that is for loading with the composition, in which the applicator:

the axis of rotation is inclined relative to the longitudinal axis and is not perpendicular thereto; and/or the applicator member is offset laterally relative to the handle so that a proximal side of the applicator surface, at a proximal end of the handle, is free.

2. A device according to claim 1, in which the axis of rotation is inclined relative to the longitudinal axis by a non-zero angle that is strictly less than 90°.

3. A device according to claim 2, in which the angle lies in the range 10° to 80°.

4. A device according to claim 2, in which the angle lies in the range 20° to 70°.

5. A device according to claim 2, in which the angle lies in the range 30° to 60°.

6. A device according to claim 1, in which the applicator member is offset laterally relative to the handle so that the proximal side of the applicator surface is free.

7. A device according to claim 6, in which the applicator surface is offset from the longitudinal axis by a distance that is greater than 2 mm.

8. A device according to claim 6, in which the applicator surface is offset from the longitudinal axis by a distance that is greater than 4 mm.

9. A device according to claim 6, in which the applicator surface is offset from the longitudinal axis by a distance that is greater than 6 mm.

10. A device according to claim 1, in which the applicator surface presents a width that is less than 3 mm.

11. A device according to claim 10, in which the applicator surface presents a width that is less than 2 mm.

12. A device according to claim 1, in which the applicator surface presents a width that is constant.

13. A device according to claim 1, in which the applicator surface presents a width that varies.

14. A device according to claim 1, in which the applicator surface is circumferentially continuous.

15. A device according to claim 1, in which the applicator surface is circumferentially discontinuous.

16. A device according to claim 1, in which the applicator surface of the applicator member comprises a plurality of disjoint regions.

17. A device according to claim 16, in which the disjoint regions share a common axis and are offset axially along the axis of rotation.

18. A device according to claim 1, in which the applicator member is connected to the handle via a pivot disposed entirely on one side of the applicator surface.

19. A device according to claim 18, in which the pivot comprises a hub and a housing in which the hub is received.

20. A device according to claim 19, in which the hub is snapped into the housing.

21. A device according to claim 19, in which the housing is formed at one end of the handle, and in which the hub is secured to the applicator member.

22. A device according to claim 21, in which the housing is a through housing.

23. A device according to claim 1, in which the applicator surface is defined by a removable part.

24. A device according to claim 1, in which the applicator surface is made integrally with an applicator member that is removably fastened to the handle.

25. A device according to claim 1, in which the longitudinal axis is rectilinear.

26. A device according to claim 1, in which the applicator member includes at least one reference mark.

27. A device according to claim 1, in which the composition is an eyeliner.

28. A device according to claim 27, in which the applicator is arranged to close the receptacle in leaktight manner while not in use.

29. A device according to claim 1, in which the receptacle comprises a sleeve that is impregnated with the composition for application.

30. A device according to claim 29, in which the sleeve is formed by an elastically-compressible foam having open cells.

31. A device according to claim 29, in which the sleeve presents an inside diameter that is small enough to enable the applicator member to come into contact with the radially-inside surface of the sleeve during storage and/or during extraction of the applicator from the receptacle.

32. A device according to claim 1, the applicator member being carried by a stem having an upper portion which is off centered relative to the receptacle.

33. A device according to claim 1, the applicator member being made at least in part out of a porous material.

34. A device according to claim 1, the applicator surface being flocked.

35. A packaging and applicator device for a makeup composition to apply on skin or lips, the device comprising:

a receptacle containing the skin or lips composition for application; and an applicator, separate from the receptacle, for applying the composition, the applicator comprising:

a handle of elongate shape, having a longitudinal axis; and a rotary applicator member movable relative to the handle about an axis of rotation that does not coincide with the longitudinal axis, the applicator member defining an applicator surface that is for loading with the composition, in which the applicator:

the axis of rotation is inclined relative to the longitudinal axis and is not perpendicular thereto; and/or the applicator member is offset laterally relative to the handle so that a proximal side of the applicator surface, at a proximal end of the handle, is free;

the applicator being configured to enable a continuous or interrupted line to be drawn on eyelids or the lips.

36. A device according to claim 35, wherein the line is less than 3 mm wide.

37. A device according to claim 1, the device comprising a case for housing a supply of the composition.

38. A device according to claim 37, the case being configured to house a cake of the composition.

39. A device according to claim 37, the case including a mirror and an integrated lighting system.

40. A device according to claim 37, the case being configured to house a plurality of different compositions.

41. A device according to claim 37, the case including a housing for the applicator, and one or more housings for different applicator members or for component parts of the applicator member enabling different traces to be made.

* * * * *